United States Patent [19]

Kleemola

[11] Patent Number: 5,069,101

[45] Date of Patent: Dec. 3, 1991

[54] DEVICE FOR REDUCING THE THICKNESS OF THE EDGE OF A BOARD WEB OR BOARD SHEETS

[75] Inventor: Pertti Kleemola, Valkeakoski, Finland

[73] Assignee: Yhtyneet Paperitehtaat Oy Walki-Pakkaus, Valkeakoski, Finland

[21] Appl. No.: 597,010

[22] Filed: Oct. 16, 1990

[30] Foreign Application Priority Data

Oct. 17, 1989 [FI] Finland ..... 4921/89

[51] Int. Cl.[5] ..... B26D 3/06

[52] U.S. Cl. ..... 83/869; 83/875; 83/344; 83/346; 83/482; 83/505; 83/507

[58] Field of Search ..... 83/869, 877, 875, 346, 83/348, 505, 432, 176, 344, 507, 482; 493/64, 82, 342, 370, 373

[56] References Cited

U.S. PATENT DOCUMENTS

| | | | |
|---|---|---|---|
| 1,611,470 | 12/1926 | Lovoy | 83/432 |
| 1,805,688 | 5/1931 | Davis | 83/869 |
| 1,965,351 | 7/1934 | Munroe | 83/432 X |
| 2,381,808 | 8/1945 | Davis et al. | 83/869 |
| 3,336,847 | 8/1967 | Durat | 493/82 X |
| 3,608,412 | 9/1971 | Braden et al. | 83/432 X |
| 3,762,255 | 10/1973 | Clash et al. | 83/678 X |
| 3,882,763 | 5/1975 | Ellerbrock | 493/82 X |

FOREIGN PATENT DOCUMENTS

| | | |
|---|---|---|
| 216221 | 5/1924 | United Kingdom . |
| 318309 | 9/1929 | United Kingdom . |
| 989874 | 4/1965 | United Kingdom . |
| 1003743 | 9/1965 | United Kingdom . |

*Primary Examiner*—Mark Rosenbaum
*Assistant Examiner*—Kenneth E. Peterson
*Attorney, Agent, or Firm*—Young & Thompson

[57] ABSTRACT

The invention relates to a device for reducing the thickness of an edge (2) of a board web (3) or board sheets, comprising a cutting blade (1); and structure for supporting, positioning and rotating the cutting blade and for guiding the edge (2) to be thinned with respect to the cutting blade (1). To provide a mechanically simple device construction of good adjustability, the cutting blade (1) is disclike; and the edge guide comprises a lower roll (4) and structure (5) for tightening the edge to be thinned against the lower roll.

2 Claims, 2 Drawing Sheets

DEVICE FOR REDUCING THE THICKNESS OF THE EDGE OF A BOARD WEB OR BOARD SHEETS

This invention relates to a device for reducing the thickness of an edge of a board web, particularly a liquid packaging board web, or board sheets, comprising a cutting blade; means for supporting, positioning and rotating the cutting blade; and means for guiding the edge to be thinned with respect to the cutting blade.

A device of the type described above for reducing the thickness of the edge of a board web is disclosed in German Offenlegungsschrift 27 50 901. When the thickness of the edge of a board web is reduced by this device, the edge can be folded without that the total thickness of the folded portion would exceed the original thickness of the web. With liquid packaging board, the folding of the edge causes it to be closed, which prevents the liquid packed in the package from entering the board web in liquid packages. The device disclosed in German Offenlegungsschrift 27 50 901 comprises a rotating hollow cutting blade against which a board sheet edge to be thinned is pressed by compressed air. With this structure, it is rather difficult to adjust the profile of the thinned edge. An even more severe problem is constituted by the use of compressed air in the adjustment of the amount of thinning. Even a minor change in the pressure of the compressed air causes variation in the thickness of the thinned edge portion.

The object of the present invention is to provide a device for reducing the thickness of the edge of a board web without the above-mentioned adjusting problems. This is achieved by means of a device of the invention, which is characterized in that the cutting blade is disc-like; and the edge guiding means comprise a lower roll and means for tightening the edge to be thinned against the lower roll. As the edge to be thinned is supported against the lower roll, its position is very accurately known. Furthermore, as the cutting blade can be accurately positioned with respect to the edge to be thinned, both the profile and the total thickness of an edge thinned by the device of the invention is accurately such as desired.

The means for positioning the cutting blade preferably comprise means for displacing the cutting blade in the direction of the edge to be thinned, in a direction perpendicular to it, and in a direction perpendicular to the other two directions, and for tilting the cutting blade around a line parallel with the edge to be thinned. By these adjustments the edge to be thinned can be given a desired profile having the shape of a wide U, in which the thinnest point, that is, the point at which the edge is to be folded, is positioned at a predetermined distance from the outer edge of the web or the sheet. When the folded edge is compressed mechanically into its final thickness, which does not exceed the original thickness of the web, the resulting edge is slightly wedge-shaped, which is advantageous in view of the use of lap joints in liquid packages.

In the following the device of the invention will be described in greater detail with reference to the attached drawing, wherein FIG. 1 is a schematic view of one exemplifying embodiment of the device of the invention;

Figure 1:
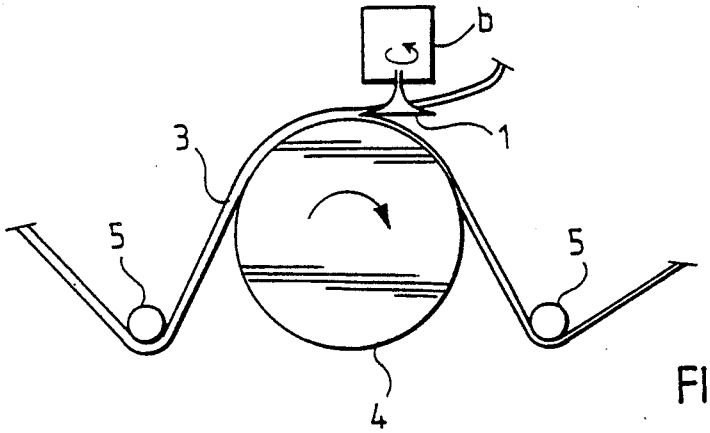
Figure 2:
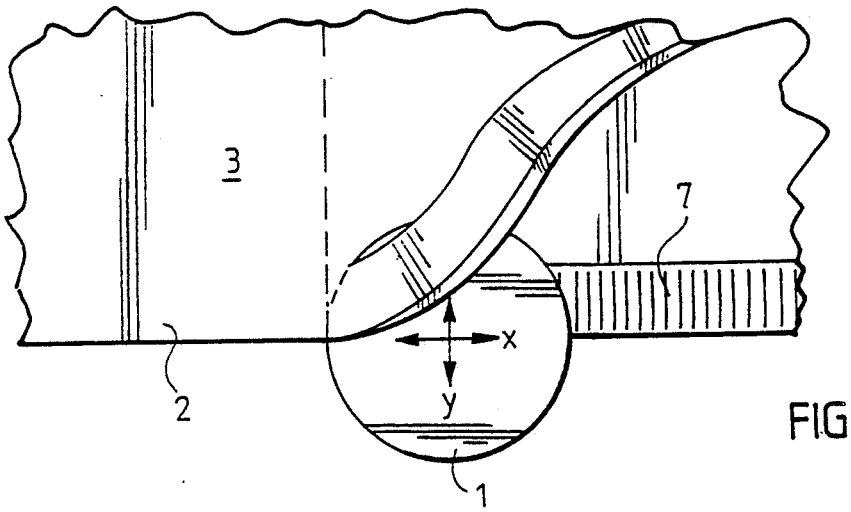
FIG. 2 illustrates from the top the position of the cutting blade with respect to the edge to be thinned.
Figure 3:
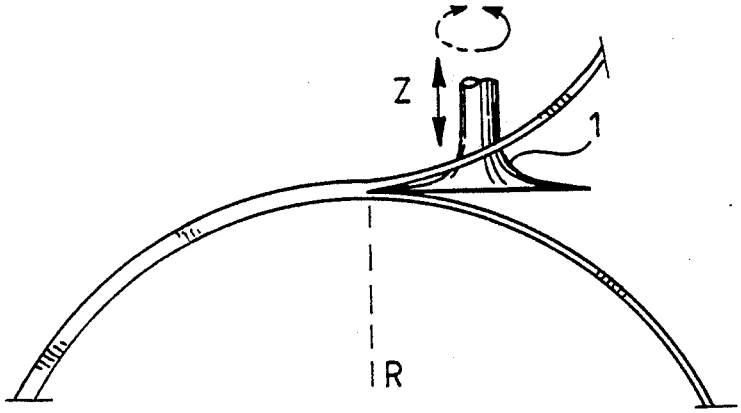
FIG. 3 illustrates the position of the cutting blade with respect to the edge to be thinned in a direction perpendicular to the edge.

FIG. 1 shows an exemplifying arrangement for the device of the invention, comprising a lower roll 4 over which a web 3 is passed. The web 3 is tightened against the roll 4 by means of movable press rolls 5. A cutting blade 1 and means 6 for supporting, positioning and rotating the cutting blade 1 are provided above the lower roll 4. The disclike cutting blade shown in FIG. 1, the cutting edge of which is positioned on its outer periphery, is shown in greater detail in FIGS. 2 to 4. FIG. 2 shows the cutting blade 1 and an edge 2 of the web 3 from above. In the figure, the arrows x and y indicate that the cutting blade 1 is displaceable in a direction x, that is, in the direction of the edge to be thinned, and in a direction perpendicular to it, that is, in a direction y. Adjustment in the direction y affects the width of a thinned portion 7. An advantageous cutting point can be achieved by adjustment in the direction x. As appears from FIGS. 1 to 3, it is preferable to position the cutting blade 1 tangentially to the vertical diametral place of the lower roll 4. FIG. 3 shows the cutting blade 1 from the end of the lower roll 4. It appears from the figure that the cutting blade 1 can also be adjusted in a vertical direction z, that is, in a direction perpendicular to the above-mentioned directions x and y. Adjustment of the blade in the direction z affects the depth of the thinning.

Figure 4:
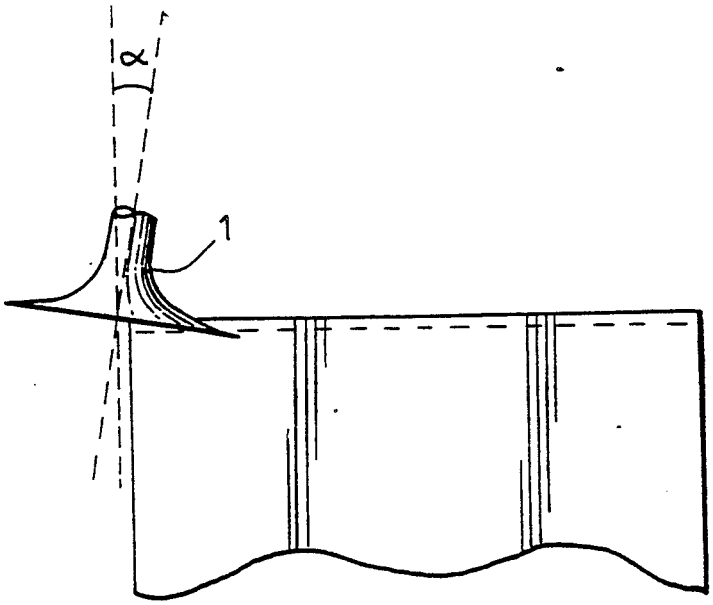
FIG. 4 illustrates the position of the cutting blade with respect to the edge to be thinned in the direction of the edge to be thinned.
Figure 5:
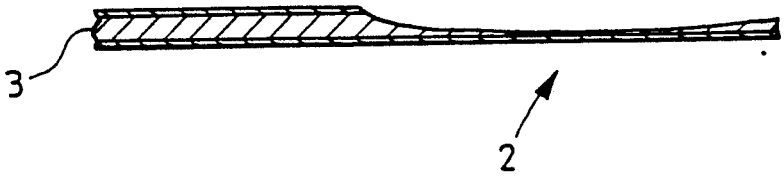
FIG. 5 shows an example of the profile of an edge thinned with the device of the invention.

In FIG. 4, the cutting blade 1 is shown from the direction of the web. As appears from the figure, the cutting blade 1 preferably forms a relatively small angle $\alpha$ (of a few degrees) with the end plane of the lower roll 4, i.e. the direction z. To achieve a wide U-shaped profile shown in FIG. 5, the cutting blade 1 has to be inclined as shown in FIG. 4, that is, it should form an angle smaller than 90° with respect to the direction y. On the other hand, to achieve a wedge-shaped edge profile the thickness of which decreases over its entire width towards the outer edge of the web, the angle between the axis of the cutting blade and the direction y may slightly exceed 9O°. It is preferable, though not necessary, that the cutting blade is rotated clockwise. The rate of rotation of the cutting blade should be relatively high, e.g., about 10,000 revolutions per minute. The desired rate of rotation depends naturally on the speed of the web to be cut and the diameter of the cutting blade. Accordingly, the cutting speed can be easily increased by increasing the diameter of the cutting blade or by increasing the rate of rotation. In the device of the invention, the desired profile of the edge is very largely dependent on the position of the blade, wherefore the other dimensions of the device can be chosen relatively freely. Typically, the diameter of the lower roll 4 is a few tens of centimetres and the diameter of the cutting blade 1 a few centimetres, e.g. 5 cm. When reducing the thickness of conventional liquid packaging boards which are plastic-laminated or in some cases aluminium-laminated and the thickness of which varies between 350 and 600 $\mu$m, the thinnest point of the U-shaped thinned portion achieved by the device of the invention may be, e.g., about 150 to 200 $\mu$m, the thickness of the outer edge being about 170 to 250 $\mu$m. The width of the thinned area is in most cases about 10 to 12 mm. As already mentioned above, the U-shaped thinned portion is advantageous in that the final folded edge will thereby be slightly wedge-shaped, in addition to which the outer edge will comprise an area which is thicker than the thinnest point, whereby it is easier to handle mechanically at high speeds.

The device of the invention has been described above only by means of one exemplifying example, which is suitable mainly for the handling of weblike products. If the device of the invention is to be used for the handling of sheets, the means for tightening the edge to be thinned have to be replaced, for instance, with a belt movable along the surface of the roll to press said edge against the lower roll. The sheets are thereby fed between the movable belt and the rotating lower roll 4.

When using the cutting device of the invention the cut edge is detached from the web or the sheet as a continuous strip without any substantial dust formation. This is a major advantage as compared with devices in which the profile of the edge is achieved by milling. This milling technique is hardly applicable when the greatest possible sterility is required from the end product.

I claim:

1. A device for reducing the thickness of an edge (2) of a board web (3) or board sheets, comprising a cutting blade (1);

means (6) for supporting, positioning and rotating the cutting blade; and means for guiding the edge (2) to be thinned with respect to the cutting blade (1);

characterized in that the cutting blade (1) is disclike; and the edge guiding means comprise a lower roll (4) and means (5) for tightening the edge to be thinned against the lower roll;

the means for positioning the cutting blade comprising means for displacing the cutting blade (1) in a first direction parallel to the edge to be thinned, in a second direction perpendicular to the edge to be thinned, and in a third direction perpendicular to both the first direction and the second direction and for tilting the blade around a line parallel with the direction (x) of the edge (2) to be thinned.

2. A device according to claim 1, characterized in that said means for tightening the edge (2) to be thinned against the lower roll (4) comprise two movable press rolls (5) positioned on opposite sides of the lower roll (4).

* * * * *